US012650257B2

(12) United States Patent
Littlejohn

(10) Patent No.: US 12,650,257 B2
(45) Date of Patent: Jun. 9, 2026

(54) HINGE COVER ASSEMBLY FOR A REFRIGERATOR APPLIANCE

(71) Applicant: Haier US Appliance Solutions, Inc., Wilmington, DE (US)

(72) Inventor: Isaiah A. Littlejohn, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 18/662,453

(22) Filed: May 13, 2024

(65) Prior Publication Data

US 2025/0347460 A1 Nov. 13, 2025

(51) Int. Cl.
*F25D 23/02* (2006.01)

(52) U.S. Cl.
CPC ..... *F25D 23/028* (2013.01); *F25D 2323/024* (2013.01)

(58) Field of Classification Search
CPC ..... F25D 23/00; F25D 23/02; F25D 23/028; F25D 23/061; F25D 2323/024; F25D 2400/40; F25D 29/005; E05D 11/0054; E05D 11/0081; E05D 2011/0072
USPC ..... 312/223.6, 400, 401, 404, 405.1
See application file for complete search history.

(56) References Cited

U.S. PATENT DOCUMENTS

| | | | | |
|---|---|---|---|---|
| 5,363,672 | A * | 11/1994 | Moore | A47F 3/0491 165/918 |
| 6,152,554 | A | 11/2000 | Parisi | |
| 7,322,209 | B2 * | 1/2008 | Hwang | F25D 23/00 62/449 |
| 9,097,046 | B2 | 8/2015 | Baer | |
| 10,646,034 | B2 | 5/2020 | Olson et al. | |
| 2003/0160551 | A1 * | 8/2003 | Beyer | E06B 5/006 312/323 |
| 2004/0189164 | A1 * | 9/2004 | Hwang | F25D 23/00 312/401 |

FOREIGN PATENT DOCUMENTS

| | | | |
|---|---|---|---|
| CA | 2270241 | C | 1/2004 |
| CN | 113819697 | A | 12/2022 |
| CN | 116294344 | A | 6/2023 |

* cited by examiner

*Primary Examiner* — Daniel J Troy
*Assistant Examiner* — Elizabeth Irene Artalejo
(74) *Attorney, Agent, or Firm* — Dority & Manning, P.A.

(57) ABSTRACT

A refrigerator appliance may include a cabinet defining a chilled chamber. The cabinet may include a top side. The refrigerator appliance may also include a hinge cover assembly disposed at the top side of the cabinet. The hinge cover assembly may define one or more enclosures at the top side of the cabinet. The hinge cover assembly may include one or more tops plates hingeably connected to the top side of the cabinet. The one or more top plates may each be hingeable between a corresponding open position and a corresponding closed position to selectively permit access to at least a portion of the one or more enclosures at the top side of the cabinet.

15 Claims, 8 Drawing Sheets

HINGE COVER ASSEMBLY FOR A REFRIGERATOR APPLIANCE

FIELD OF THE DISCLOSURE

The present subject matter relates generally to a refrigerator appliance and more particularly to a hinge cover assembly for a refrigerator appliance.

BACKGROUND OF THE DISCLOSURE

Refrigerator appliances generally include a cabinet that defines one or more chilled chambers for receipt of food articles for storage. Typically, one or more doors are rotatably hinged to the cabinet to permit selective access to food items stored in the chilled chamber. Further, refrigerator appliances commonly include one or more storage bins or drawers positioned within the chilled chamber. Food items, or various other items, that require refrigeration may be placed within the storage drawers, e.g., for organization or compartmentalization of items that require refrigeration.

Some refrigerator appliances have incorporated one or more hinge covers to cover or protect door hinges of the refrigerator appliance. For instance, one or more plastic covers may be provided to cover or protect the door hinges of the refrigerator appliance. Although such covers may provide increased cosmetics and protection, issues may arise with existing hinge covers. For instance, due to the location of the hinge covers, instances may arise in which ergonomic constraints make it difficult, or impossible, to properly assemble the hinge covers to the refrigerator appliance. This may, in turn, reduce craftsmanship and robustness of the refrigerator appliance. Moreover, space in or around the one or more hinge covers can often be difficult to access (e.g., for an operator of the refrigerator appliance). This may, in turn, make assembly or maintenance of the refrigerator appliance for an operator difficult.

Accordingly, it would be useful to provide an appliance or assembly configured to mitigate one or more of the above-identified issues.

BRIEF DESCRIPTION OF THE DISCLOSURE

Aspects and advantages of the invention will be set forth in part in the following description, or may be obvious from the description, or may be learned through practice of the invention.

In one exemplary aspect of the present disclosure, a refrigerator appliance is provided. The refrigerator appliance may include a cabinet defining a chilled chamber. The cabinet may include a top side. The refrigerator appliance may also include a hinge cover assembly disposed at the top side of the cabinet. The hinge cover assembly may define one or more enclosures at the top side of the cabinet. The hinge cover assembly may include one or more tops plates hingeably connected to the top side of the cabinet. The one or more top plates may each be hingeable between a corresponding open position and a corresponding closed position to selectively permit access to at least a portion of the one or more enclosures at the top side of the cabinet.

In another exemplary aspect of the present disclosure, a refrigerator appliance is provided. The refrigerator appliance may define a vertical direction, a lateral direction, and a transverse direction. The refrigerator appliance may include a cabinet defining a chilled chamber. The cabinet may include a bottom side and top side spaced apart along the vertical direction. The refrigerator appliance may include a hinge cover assembly. The hinge cover assembly may be disposed at the top side of the cabinet. The hinge cover assembly may define an enclosure at the top side of the cabinet. The hinge cover assembly may include a first hinge mount disposed at the top side of the cabinet. The hinge cover assembly may include a second hinge mount disposed at the top side of the cabinet. The first hinge mount and the second hinge mount may be spaced apart along the lateral direction. The top plate may be hingeably connected to the first hinge mount and the second hinge mount.

In yet another exemplary aspect of the present disclosure, a refrigerator appliance is provided. The refrigerator appliance may define a vertical direction, a lateral direction, and a transverse direction. The refrigerator appliance may include a cabinet defining a chilled chamber. The cabinet may include a top side. The refrigerator appliance may include a hinge cover assembly disposed at the top side of the cabinet. The hinge cover assembly may define a plurality of enclosures at the top side of the cabinet. The hinge cover assembly may include a plurality of top plates. Each top plate of the plurality of top plates may define an enclosure at the top side of the cabinet. The hinge cover assembly may include a plurality of dedicated hinges. Each dedicated hinge of the plurality of dedicated hinges may be mounted to the cabinet and a top plate of the plurality of top plates. The plurality of top plates are each hingeable between an open position and a closed position via the plurality of dedicated hinges.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
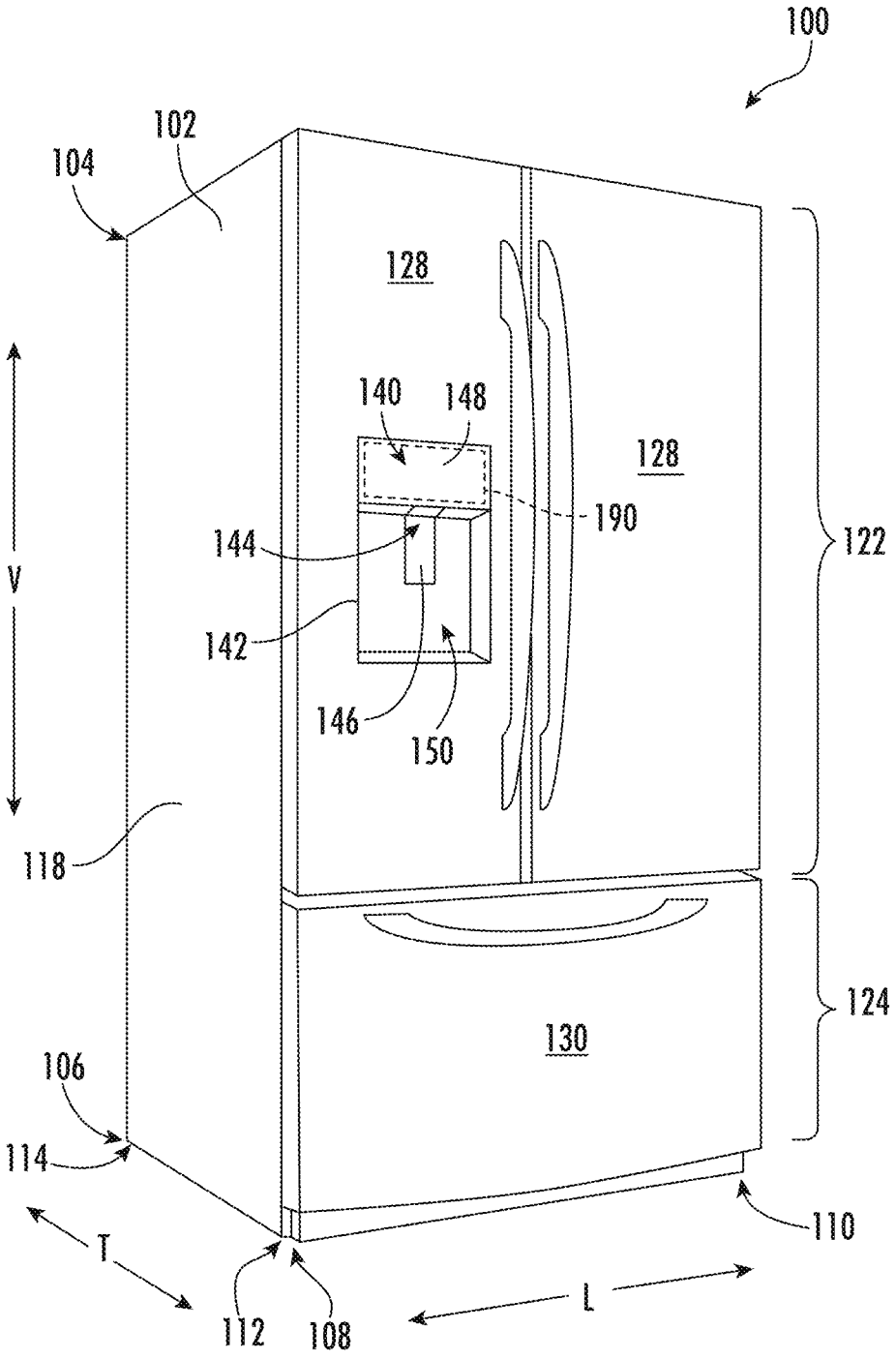
FIG. 1 provides a perspective view of a refrigerator appliance according to one or more exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents. The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V). The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Except as explicitly indicated otherwise, recitation of a singular processing element (e.g., "a controller," "a processor," "a microprocessor," etc.) is understood to include more than one processing element. In other words, "a processing element" is generally understood as "one or more processing element." Furthermore, barring a specific statement to the contrary, any steps or functions recited as being performed by "the processing element" or "said processing element" are generally understood to be capable of being performed by "any one of the one or more processing elements." Thus, a first step or function performed by "the processing element" may be performed by "any one of the one or more processing elements," and a second step or function performed by "the processing element" may be performed by "any one of the one or more processing elements and not necessarily by the same one of the one or more processing elements by which the first step or function is performed." Moreover, it is understood that recitation of "the processing element" or "said processing element" performing a plurality of steps or functions does not require that at least one discrete processing element be capable of performing each one of the plurality of steps or functions.

Generally, a refrigerator appliance may be provided in some aspects of the present disclosure. The refrigerator appliance can include a cabinet defining one or more chilled chambers. The cabinet can include a case body that defines at least two external sides (e.g., the left side, the right side, and the top side) of the cabinet. Notably, the refrigerator appliance can have a hinge cover assembly defining one or more enclosures at the top side of the cabinet. The one or more enclosures may be able to house or enclose one or more components of the refrigerator appliance (e.g., one or more operational components of the refrigerator appliance, such as one or more control boards, electrical wires, water lines, etc.). Moreover, the hinge cover assembly can include one or more features, such as one or more top plates, that are hingeably connected to the top side of the case body. The one or more features can selectively transition between an open position and a closed position to selectively permit (or inhibit) access to the one or more enclosures at the top side of the case body.

Notably, the presence of the enclosures at the top side of the case body or the increased accessibility of the components housed within the enclosure advantageously improves the assembly or maintenance of the refrigerator appliance.

Figure 2:
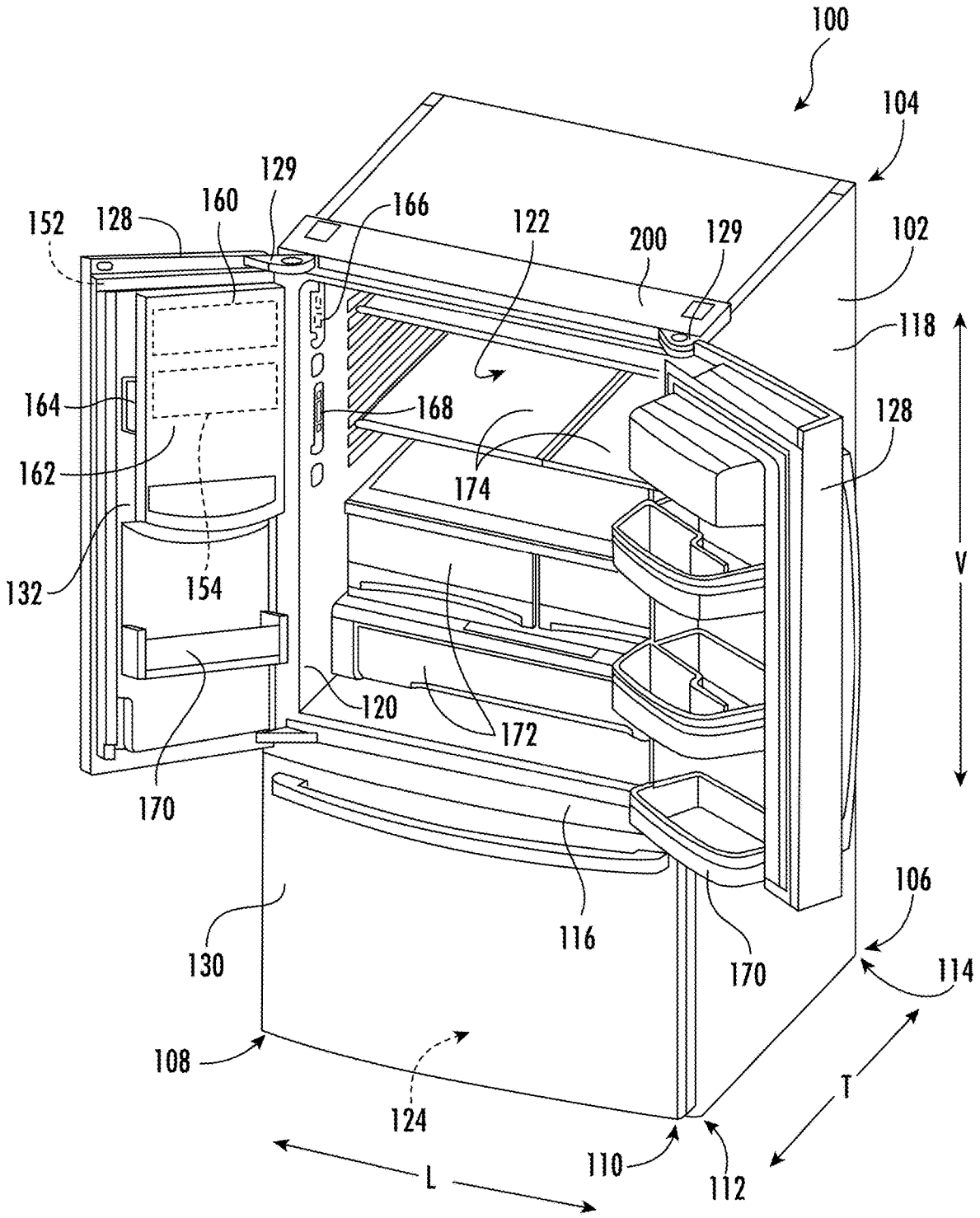
FIG. 2 provides a perspective view of the example refrigerator appliance shown in FIG. 1, wherein a refrigerator door is in an open position according to one or more exemplary embodiments of the present disclosure.

Turning to the figures, FIGS. 1 and 2 illustrate perspective views of an exemplary refrigerator appliance 100. Refrigerator appliance 100 includes a housing or cabinet 102 having a case body 118. In general, the cabinet 102 extends between a top side 104 and a bottom 106 along a vertical direction V, between a first side 108 (e.g., a left side) and a second side 110 (e.g., a right side) along a lateral direction L, and between a front side 112 and a rear side 114 along a transverse direction T. Each of the vertical direction V, lateral direction L, and transverse direction T are mutually perpendicular to one another and form an orthogonal direction system.

In some embodiments, the case body 118 of the cabinet 102 is a portion of the cabinet 102. For instance, the case body 118 may define at least two external sides, e.g., the left side and the right side, of the cabinet 102. For instance, in some embodiments, the case body 118 is formed into a "U" shape from a piece of sheet metal to provide the top side 104, the left side, and the right side of the cabinet. In addition, the case body may extend approximately along the transverse direction T to define the front and the back of the refrigerator appliance.

As shown, cabinet 102 generally defines chilled chambers for receipt of food items for storage. In particular, cabinet 102 defines fresh food chamber 122 proximate to, or adjacent to, top side 104 of cabinet 102 and a freezer chamber 124 arranged proximate to, or adjacent to, bottom 106 of cabinet 102. As such, refrigerator appliance 100 is generally referred to as a bottom mount refrigerator. It is recognized, however, that the benefits of the present disclosure apply to other types and styles of refrigerator appliances such as, for example, a top mount refrigerator appliance or a side-by-side style refrigerator appliance. Consequently, the description set forth herein is for illustrative purposes only and is not intended to be limiting in any aspect to any particular refrigerator chamber configuration.

According to the illustrated embodiment, various storage components are mounted within fresh food chamber 122 to facilitate storage of food items therein as will be understood by those skilled in the art. In particular, the storage components include bins 170, drawers 172, and shelves 174 that are mounted within fresh food chamber 122. Bins 170, drawers 172, and shelves 174 are positioned to receive of food items (e.g., beverages or solid food items) and may assist with organizing such food items. As an example, drawers 172 can receive fresh food items (e.g., vegetables, fruits, or cheeses) and increase the useful life of such fresh food items. In some embodiments, a lateral mullion 116 is positioned within cabinet 102 and separating freezer chamber 124 and the fresh food chamber 122 along a vertical direction V.

Refrigerator doors 128 are rotatably hinged to an edge of cabinet 102 for selectively accessing fresh food chamber 122 and extending across at least a portion of fresh food chamber 122. Particularly, the refrigerator doors 128 may be rotatably hinged to door hinges 129 disposed at the edges of the cabinet 102. A hinge cover assembly 200 (described in more detail below) may be positioned over or around the door hinges 129. The hinge cover assembly 200 may generally cover and protect the door hinges 129. More particularly, the hinge cover assembly 200 may house or enclose one or more components of the refrigerator appliance (e.g., one or more operational components of the refrigerator appliance, such as one or more control boards, electrical wires, water lines, etc.).

A freezer door 130 may be arranged below refrigerator doors 128 for selectively accessing freezer chamber 124 and extending across at least a portion of freezer chamber 124. Freezer door 130 is coupled to a freezer drawer (not shown) slidably mounted within freezer chamber 124. Refrigerator doors 128 and freezer door 130 are each shown in the closed position in FIG. 1 (e.g., a first closed position corresponding to doors 128, and a second closed position corresponding to door 130).

In optional embodiments, refrigerator appliance 100 includes a delivery assembly 140 for delivering or dispensing liquid water or ice. Delivery assembly 140 includes a dispenser 142 positioned on or mounted to an exterior portion of refrigerator appliance 100 (e.g., on one of refrigerator doors 128). Dispenser 142 includes a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A user interface panel 148 is provided for directing (e.g., selecting) the mode of operation. For example, user interface panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open refrigerator doors 128. In exemplary embodiments, dispenser recess 150 is positioned at a level that approximates the chest level of a user. During certain operations, the dispensing assembly 140 may receive ice from an icemaker 152 mounted in a sub-compartment of the fresh food chamber 122, as described below.

Operation of the refrigerator appliance 100 can be generally controlled or regulated by a controller 190. In some embodiments, controller 190 is operably coupled (e.g., electrically coupled or wirelessly coupled) to user interface panel 148 or various other components. In some such embodiments, user interface panel 148 provides selections for user manipulation of the operation of refrigerator appliance 100. As an example, user interface panel 148 may provide for selections between whole or crushed ice, chilled water, a specific temperature of operation for either chilled chamber 122, 124, or specific modes of operation. In response to one or more input signals (e.g., from user manipulation of user interface panel 148 or one or more sensor signals), controller 190 may operate various components of the refrigerator appliance 100 according to the current mode of operation.

Controller 190 may include a memory (e.g., non-transitory storage media) and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In some embodiments, the processor executes programming instructions stored in memory. For certain embodiments, the instructions include a software package configured to operate appliance 100 and, for example, execute an operation routine. The memory may be a separate component from the processor or may be included onboard within the processor. Alternatively, controller 190 may be constructed without using a microprocessor (e.g., using a combination of discrete analog or digital logic circuitry, such as switches, amplifiers, integrators, comparators, flip-flops, AND gates, and the like) to perform control functionality instead of relying upon software.

Controller 190, or portions thereof, may be positioned in a variety of locations throughout refrigerator appliance 100. In exemplary embodiments, controller 190 is located within the user interface panel 148. In other embodiments, the controller 190 may be positioned at any suitable location within refrigerator appliance 100, such as for example within the fresh food chamber 122, a freezer door 130, etc. Input/output (i.e., "I/O") signals may be routed between controller 190 and various operational components of refrigerator appliance 100. For example, user interface panel 148 may be operably coupled to controller 190 via one or more signal lines or shared communication busses.

As illustrated, controller 190 may be operably coupled to the various components of appliance 100 and may control operation of the various components. For example, various sensors, switches, valves, fans, compressor, etc. may be actuatable or selectively activated based on commands from the controller 190. As discussed, interface panel 148 may additionally be operably coupled to the controller 190. Thus, the various operations may occur based on user input or automatically through controller 190 instruction.

FIG. 2 provides a perspective view of refrigerator appliance 100 shown with refrigerator doors 128 in the open position. In optional embodiments, a secondary liner (e.g., icebox liner 132) defining a sub-compartment (e.g., icebox compartment 160) is attached (e.g., mechanically connected directly or indirectly) to cabinet 102. For instance, in some embodiments, at least one door 128 includes icebox liner 132 positioned thereon. In turn, icebox compartment 160 is defined within one of doors 128. Nonetheless, additional or alterative embodiments may include an icebox compartment defined at another portion of refrigerator appliance 100 (e.g., within door 130 or fresh food chamber 122). An ice making assembly or icemaker 152 may be positioned or mounted within icebox compartment 160. Ice may be supplied to dispenser recess 150 (FIG. 1) from the icemaker 152 in icebox compartment 160 on a back side of refrigerator door 128.

An access door (e.g., icebox door 162 having a suitable latch 164) may be hinged to icebox compartment 160 to selectively cover or permit access to opening of icebox compartment 160. Optionally, the icebox compartment 160 may receive cooling air from a chilled air supply duct 166 and a chilled air return duct 168 positioned on a side portion of cabinet 102 of refrigerator appliance 100. Additionally or alternatively, an icemaker 152 and ice bucket or storage bin 154 are provided within icebox compartment 160.

Figure 3:
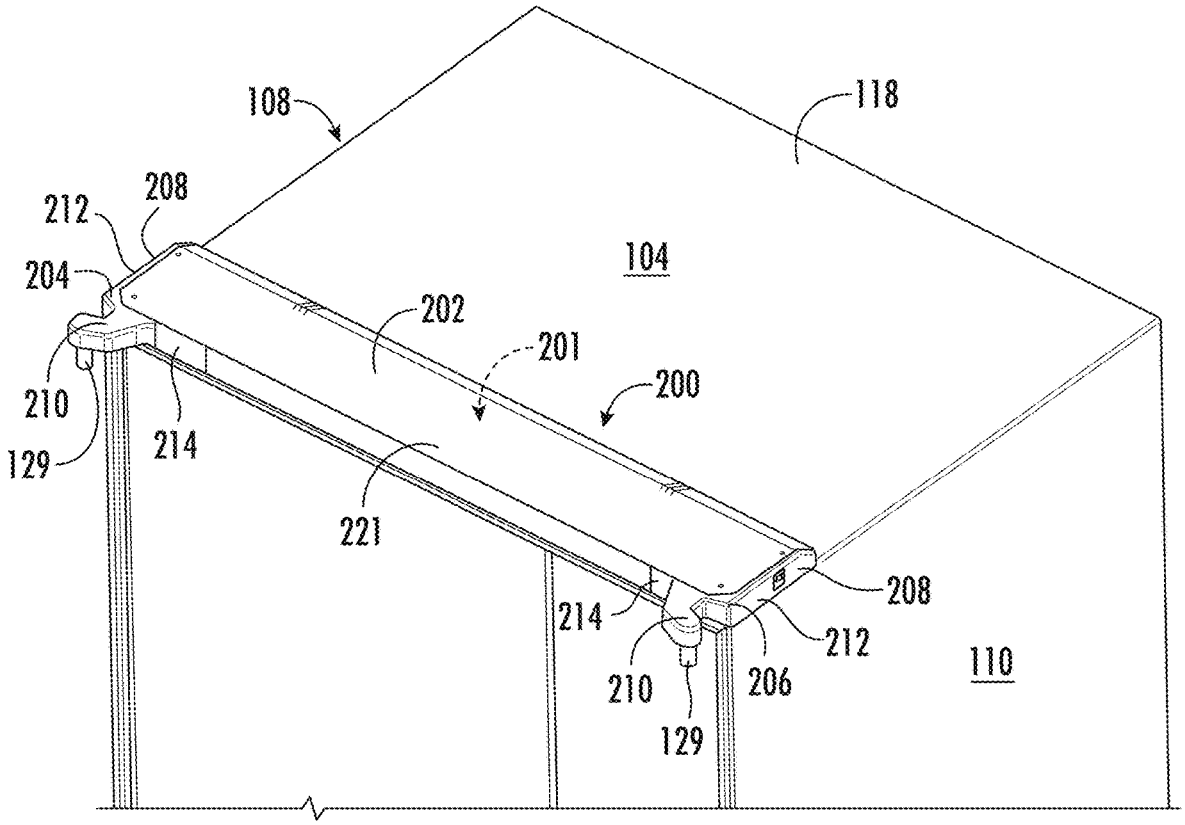
FIG. 3 provides a perspective view of a hinge cover assembly disposed at a top side of a case body according to one or more exemplary embodiments of the present subject matter.
Figure 4:
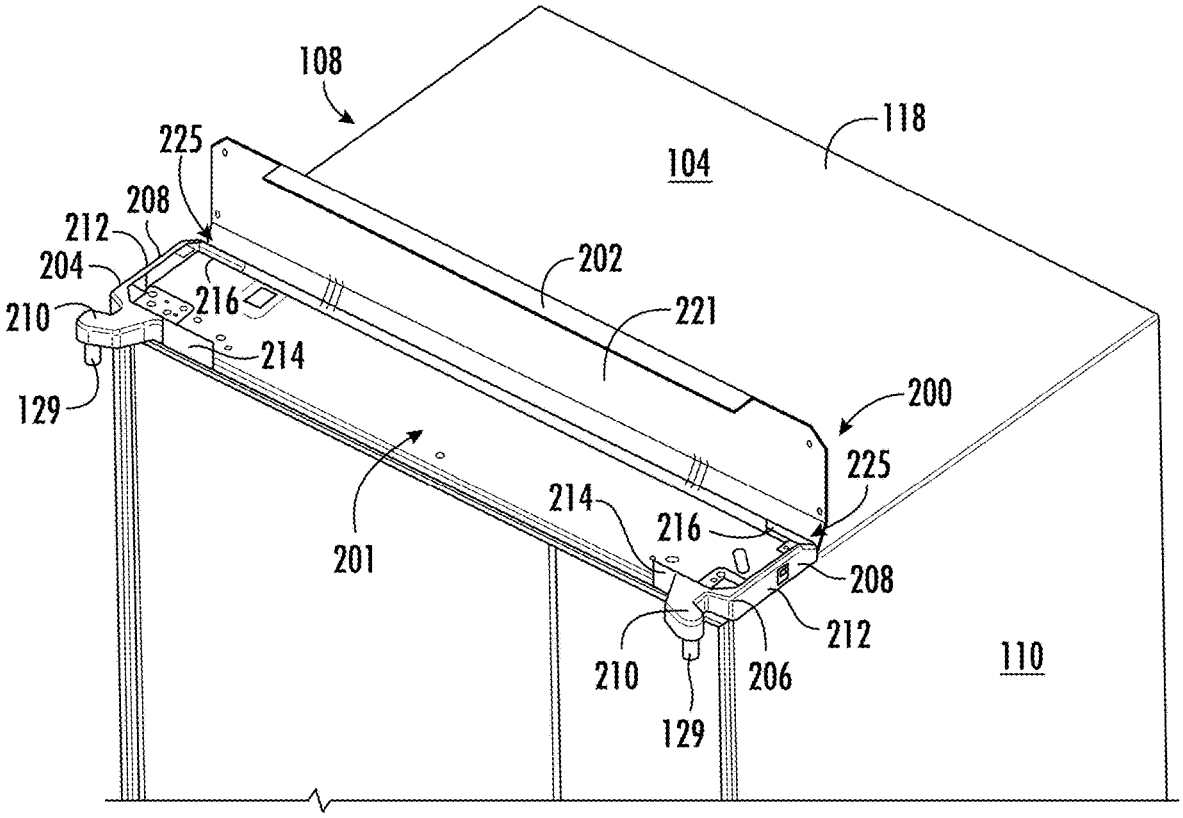
FIG. 4 provides a perspective view of the exemplary hinge cover assembly of FIG. 3, wherein a top plate of the hinge cover assembly is in an open position.
Figure 5:
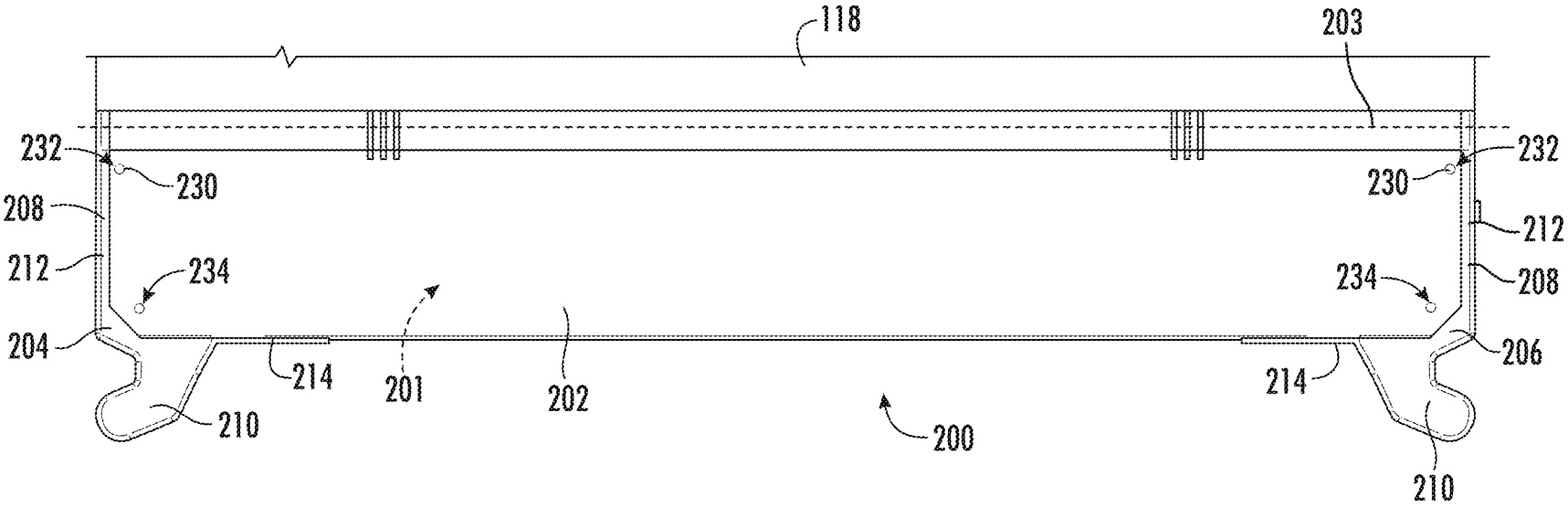
FIG. 5 provides an elevation view of the exemplary hinge cover assembly of FIG. 3.
Figure 6:
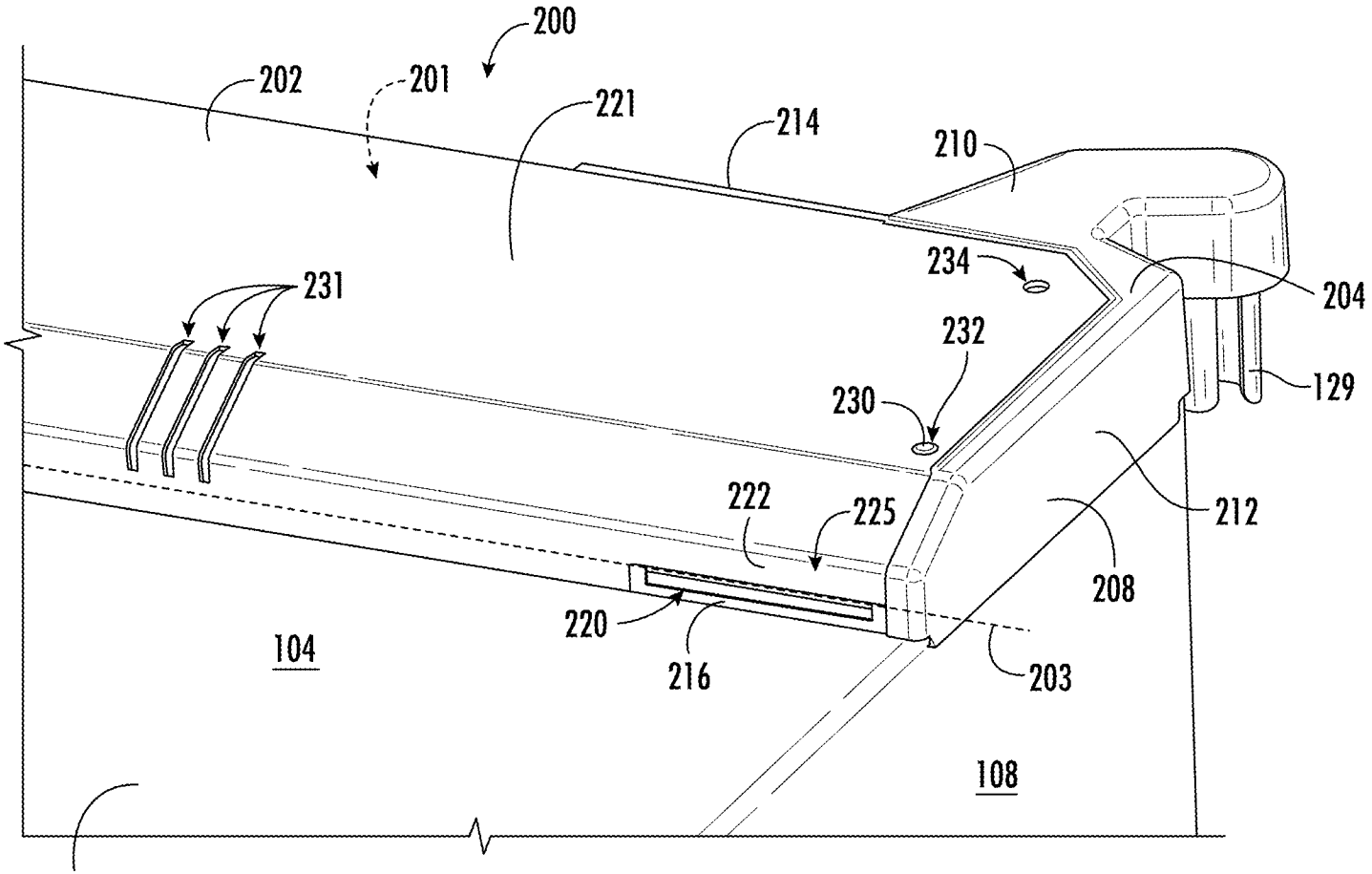
FIG. 6 provides a rear perspective view of a living hinge of the exemplary hinge cover assembly of FIG. 3.

Referring now to FIGS. 3 and 4, perspective views of the case body 118 and the exemplary hinge cover assembly 200 disposed at the top side 104 of the case body 118 are provided. As mentioned above, the case body 118 may be a portion of the cabinet 102. For example, the case body 118 may define at least two external sides, such as the first side 108 and the second side 110, of the cabinet 102. For instance, in some embodiments, the case body 118 is formed into a "U" shape from a piece of sheet metal to provide the top side 104, the first side 108, and the second side 110 of the cabinet 102. In addition, the case body 118 may extend approximately along the transverse direction T to define the front side 112 and the rear side 114 of the refrigerator appliance 100.

The hinge cover assembly 200 may be disposed at the top side 104 of the case body 118, such as at a front top edge of the case body 118, e.g., as illustrated, or at another location at the top side 104 of the case body 118, e.g., a portion of the top side 104 of the case body 118 between a front edge and a rear edge of the case body 118. The hinge cover assembly 200 may define an enclosure 201 at the top side 104 of the case body 118. The enclosure 201 may house or enclose one or more components of the refrigerator appliance 100 at the top side 104 of the case body 118. For instance, the one or more components that are housed within the enclosure 201 may include one or more electrical components (e.g., control boards, electrical wires, wire harnesses, etc.), one or more non-electrical components (e.g., water lines, fasteners, etc.), or any other suitable component that may be utilized in the functioning of the refrigerator appliance 100.

In addition, the hinge cover assembly 200 may advantageously allow these components to be easily accessible (e.g., to a user or an operator of the refrigerator appliance 100). For instance, a top plate 202 of the hinge cover assembly 200 may be hingeably connected to the top side 104 of the case body 118. The top plate 202 may be hingeable about an axis of rotation 203 of the hinge cover assembly 200. The axis of rotation 203 may extend along the lateral direction L (e.g., as illustrated). Particularly, the top plate 202 may be hingeable between a closed position (e.g., FIG. 3) and an open position (e.g., FIG. 4). In the open position of the hinge cover assembly 200, the enclosure 201 defined by the hinge cover assembly 200 may be accessible (e.g., to a user or an operator of the refrigerator appliance 100).

Referring now to FIGS. 3 through 8, aspects of the hinge cover assembly 200 are described in detail herein. As mentioned above, the hinge cover assembly 200 may include a top plate 202 hingeably connected to the top side 104 of the case body 118. In addition, the hinge cover assembly 200 may include a first hinge mount 204 and a second hinge mount 206. In some embodiments, the first hinge mount 204 or the second hinge mount 206 may each include an enclosure portion 208 and a door portion 210.

The enclosure portion 208 of the first hinge mount 204 or the second hinge mount 206 may be connected to the top side 104 of the case body 118 and the top plate 202. Particularly, the top plate 202 may be hingeably connected to the first hinge mount 204 or the second hinge mount 206. The door portion 210 of the first hinge mount 204 or the second hinge mount 206 may be extended from the respective enclosure portion 208 such that the door portion 210 is positioned over or around the door hinges 129 to cover or protect the door hinges 129. For example, the door portions 210 of the first hinge mount 204 or the second hinge mount 206 may be connected or attached to a top side of the door hinges 129. In this regard, the door hinges 129 may be covered and protected by the door portions 210 of the first hinge mount 204 or the second hinge mount 206.

The first hinge mount 204 and the second hinge mount 206 may each be disposed at the top side 104 of the case body 118. Moreover, the first hinge mount 204 and the second hinge mount 206 may be positioned at opposing sides (e.g., along the lateral direction L) of the case body 118. For example, the first hinge mount 204 and the second hinge mount 206 may be positioned at the front top corners of the case body 118.

However, in alternative exemplary embodiments, the first hinge mount 204 and the second hinge mount 206 may be positioned at any other suitable location at the top side 104 of the case body 118. For example, in alternative exemplary embodiments, the first hinge mount 204 or the second hinge mount 206 may be positioned at a back top corner of the case body 118.

The enclosure portion 208 of the first hinge mount 204 or the second hinge mount 206 may include a side wall 212, a front wall 214, and a first hinge element 216 (e.g., a rear wall). The side wall 212 and the front wall 214 of the first hinge mount 204 and the second hinge mount 206 may each form an "L" shape at the front top corners of the case body 118. The side wall 212 of each enclosure portion 208 may be disposed at, or connected to, a top edge (e.g., a top lateral edge, such as the edge formed between the first side 108 and the top side 104 or the edge formed between the second side 110 and the top side 104) of the case body 118. The front wall 214 of each enclosure portion 208 may be disposed at, or connected to, the front side or front edge of the case body 118.

The first hinge element 216 (e.g., of the first hinge mount 204 or the second hinge mount 206) may be positioned at a rear end of the respective side wall 212. Particularly, the first hinge element 216 may include a vertical wall 218. The vertical wall 218 may define a slot 220 (e.g., a horizontal slot) therethrough. As will be described in more detail below, the slot 220 may receive a second hinge element 222 therethrough. The second hinge element 222 may be hingeably connected to the first hinge element 216 at the top side 104 of the case body 118. The first hinge element 216 (e.g., the first hinge element 216 of the first hinge mount 204 or the second hinge mount 206) and the second hinge element 222 may together form a living or an integrated hinge 225 between the top plate 202 and the first hinge mount 204 or between the top plate 202 and the second hinge mount 206. Notably, the living hinge(s) 225 formed at the top side 104 of the case body 118 define the axis of rotation 203 and may allow the top plate 202 of the hinge cover assembly 200 to transition between the closed position and the open position (e.g., about the axis of rotation 203).

Figure 7:
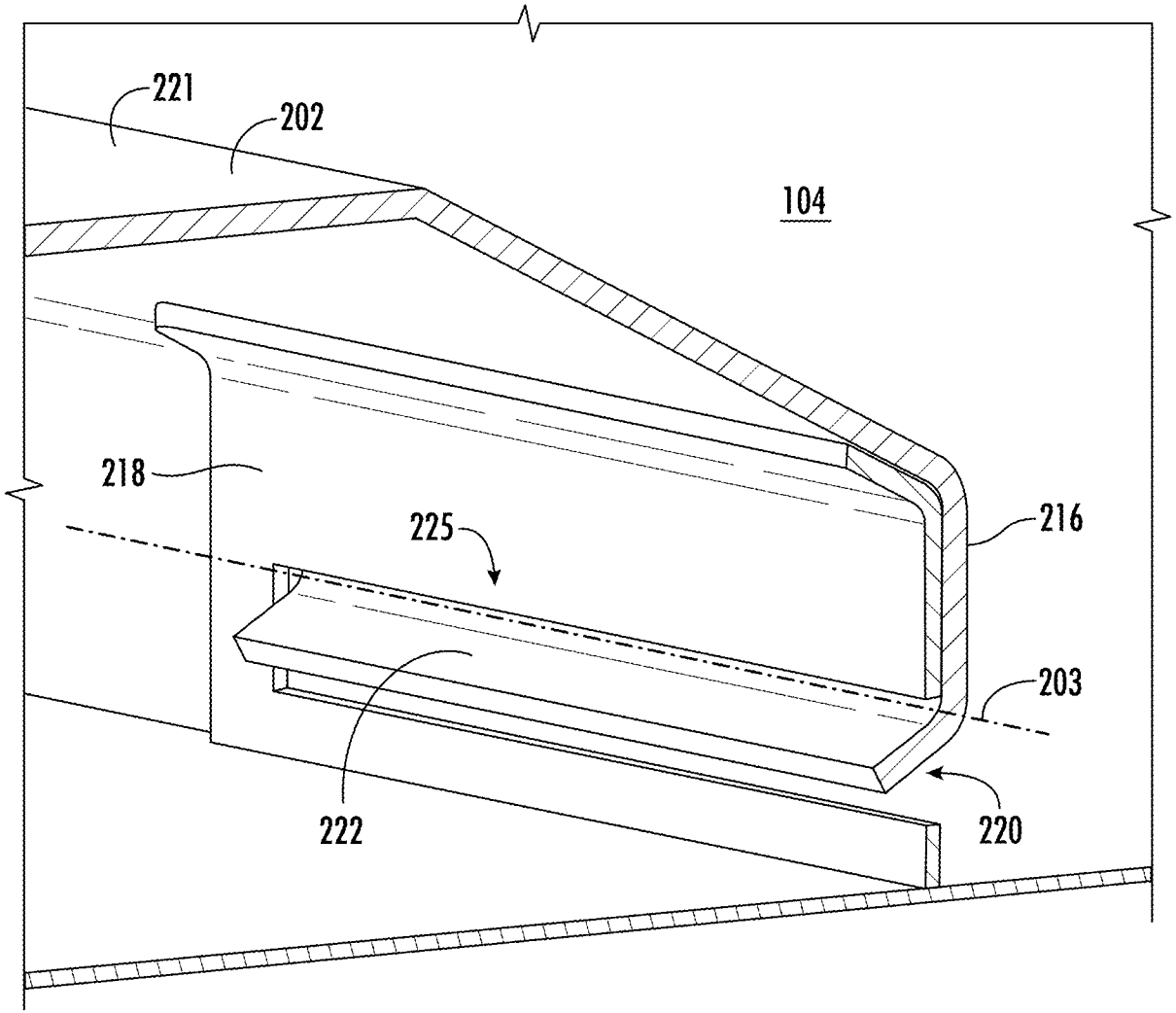
FIG. 7 provides a front cutaway view of the living hinge of the exemplary hinge cover assembly of FIG. 3.

In some embodiments, the top plate 202 of the hinge cover assembly 200 includes a main plate 221 and a pair of second hinge elements 222. The pair of second hinge elements 222 may be spaced apart (e.g., along the lateral direction L) such that each second hinge element is positioned at an opposing lateral side of the main plate 221. In some embodiments, each second hinge element of the pair of second hinge elements 222 may be extended from a rear portion of the main plate 221. For example, as illustrated in FIG. 7, the second hinge element may be extended inward from a bottom rear corner of the main plate 221. The second hinge element 222 may be inserted into the corresponding slot 220 defined by the vertical wall 218 of the first hinge mount 204 or the second hinge mount 206.

In some embodiments, the top plate 202 of the hinge cover assembly 200 includes, or is constructed from, a fire-resistant material (e.g., a material that prevents or retards the passage of excessive heat, hot gasses, or flames under conditions of use). For example, the first resistant material may be a fire-resistant metal material such as steel, aluminum, iron, or any other suitable fire-resistant metal material. Additionally or alternatively, the top plate 202 may define one or more vents 231 (e.g., FIG. 7) therethrough. For example, the one or more vents 231 may be one or more slots, apertures, holes, or any other suitable orifice defined through the top plate 202. The vents 231 may be configured to quickly displace unwanted air or fumes that may be within the enclosure 201. In this regard, the enclosure 201 defined by the hinge cover assembly 200 may function as a fire resistant enclosure (e.g., a fire-resistant enclosure that may satisfy one or more regulatory requirements, such as Underwriters laboratories (UL) regulatory requirements for refrigeration appliances).

Additionally or alternatively, the first hinge mount 204 or the second hinge mount 206 may include one or more first locating features that may engage with one or more corresponding locating features of the top plate 202. As illustrated, the first hinge mount 204 and the second hinge mount 206 each include a locating pin 230 extending upward therefrom. When transitioning from the open position to the closed position, a complementary locating slot 232 defined through the top plate 202 may receive the locating pin 230 of the first hinge mount 204 or the second hinge mount 206. In this regard, when the top plate 202 is transitioned from the open position to the closed position, the locating pins 230 and the corresponding locating slots 232 may facilitate in the locating or the alignment of the top plate 202 relative the first hinge mount 204 and the second hinge mount 206.

Optionally, in the closed position, the top plate 202 may be mechanically fastened to the first hinge mount 204 or the second hinge mount 206. For instance, the top plate 202 of the hinge cover assembly 200 may include one or more fastener holes 234 that one or more mechanical fasteners may be received therethrough to mechanically fasten the top plate 202 to the first hinge mount 204 or the second hinge mount 206. The mechanical fasteners may be removable or temporary fasteners, such as bolts or screws, that may join the top plate 202 to the first hinge mount 204 or the second hinge mount 206 with the option of being removed. In this regard, the enclosure 201 defined by the hinge cover assembly 200 may be secured in the closed position (e.g., during general operation of the refrigerator appliance 100) and selectively unsecured to permit movement of the top plate from the closed position to the open position (e.g., during an assembly or maintenance operation of the refrigerator appliance 100).

Figure 8:
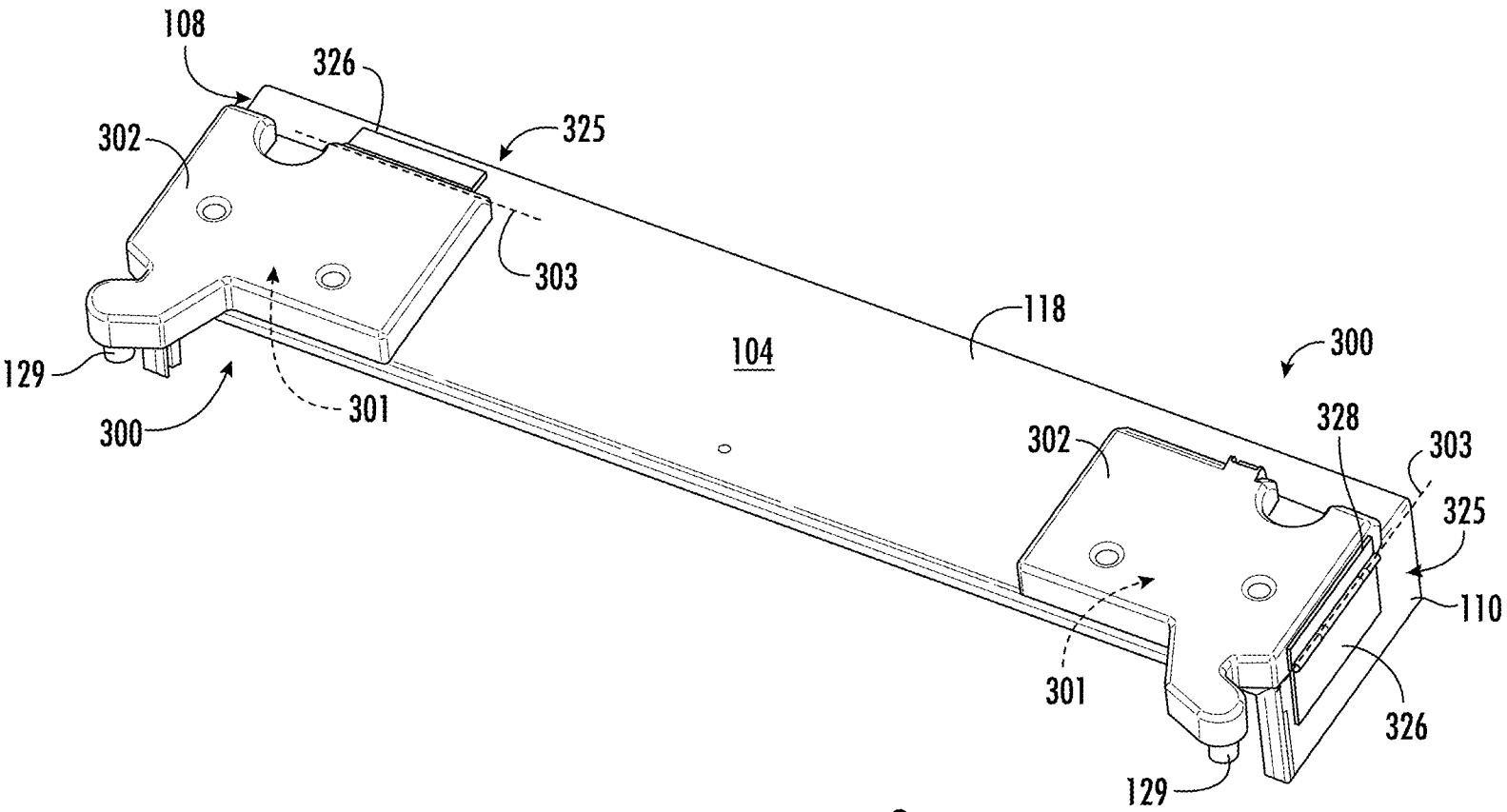
FIG. 8 provides a perspective view of a hinge cover assembly disposed at a top side of a case body according to one or more exemplary embodiments of the present subject matter.

Referring now to FIG. 8, a perspective view of a hinge cover assembly 300 in accordance with another exemplary aspect of the present disclosure is provided. The exemplary hinge cover assembly 300 of FIG. 8 may be configured in substantially the same manner as the exemplary hinge cover assembly 200 of FIGS. 3 through 7, and accordingly, the same or similar numbers may refer to the same or similar parts.

For example, the exemplary hinge cover assembly 300 of FIG. 8 may define one or more enclosures 301 for housing one or more components of the refrigerator appliance 100 at the top side 104 of the case body 118. However, for the embodiment of FIG. 8, the hinge cover assembly 300 may include a plurality of top plates 302 and a plurality of dedicated hinges 325. The plurality of top plates 302 may be disposed at the top side 104 of the case body 118. Each top plate of the plurality of top plates 302 may define a discrete enclosure 301 for housing one or more components of the refrigerator appliance 100. The plurality of dedicated hinges 325 each may be mounted to the case body 118 and to a discrete top plate of the plurality of top plates 302 to hingeably connect each top plate of the plurality of top plates 302 to the case body 118.

Each dedicated hinge of the plurality of dedicated hinges 325 may be any suitable style, type, or configuration of hinge. For example, each dedicated hinge of the plurality of dedicated hinges 325 may be a ball bearing style hinge, a butt hinge, an overlay hinge, or any other suitable type of hinge. As illustrated in FIG. 8, the exemplary dedicated hinges 325 may be a butt style hinge that hingeably connects the top plates 302 to the case body 118. Particularly, the exemplary dedicated hinges 325 may include a first element 326 and a second element 328. The first element 326 of each dedicated hinge 325 may be hingeably coupled to the second element 328 of each dedicated hinge 325. The first element 326 of each dedicated hinge 325 may be fastened to the top side 104, the first side 108 or the second side 110 of the case body 118. The second element 328 of each dedicated hinge 325 may be coupled or fastened to a discrete top plate of the plurality of top plates 302. Each dedicated hinge of the plurality of dedicated hinges 325 may define an axis of rotation 303 that the respective top plate 302 may be capable of hinging about. For the embodiment of FIG. 8, the axis of rotation 303 of each dedicated hinge 325 may extend parallel to one of the lateral direction L or the transverse direction T.

Notably, embodiments of the present disclosure may advantageously provide a hinge cover assembly that may be disposed at the top side of the refrigerator appliance. In one or more embodiments, the hinge cover assembly may advantageously include one or more top plates that are hingeably connected to a top side of the refrigerator appliance (e.g., via the formation of a living or integrated hinge or one or more dedicated hinges). Notably, the one or more top plates may form and provide selective access to one or more enclosures at the top side of the refrigerator appliance. The one or more enclosures may house or enclose one or more components of the refrigerator appliance therewithin.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance comprising:

a cabinet defining a chilled chamber, the cabinet comprising a top wall, the top wall comprising a top face; and a hinge cover assembly disposed at the top wall of the cabinet, the hinge cover assembly defining one or more enclosures at the top wall of the cabinet, and configured to cover at least a portion of a refrigerator door hinge, the hinge cover assembly comprising:

one or more tops plates hingeably connected to the top face of the cabinet, wherein the one or more top plates are each hingeable between a corresponding open position and a corresponding closed position to selectively permit access to at least a portion of the one or more enclosures at the top wall of the cabinet, and wherein the one or more top plates are parallel to the top face in the closed position.

2. The refrigerator appliance of claim 1, wherein the hinge cover assembly further comprises one or more hinge mounts positioned at the top face of the cabinet, wherein the one or more top plates are hingeably connected to the one or more hinge mounts to form a living hinge at the top face of the cabinet.

3. The refrigerator appliance of claim 2, wherein the one or more hinge mounts comprises a first hinge mount and a second hinge mount, wherein the first hinge mount and the second hinge mount are positioned at the top face of the cabinet, wherein the first hinge mount and the second hinge mount are positioned at opposing sides of the cabinet, and wherein the one or more top plates comprises a main plate hingeably connected to the first hinge mount and the second hinge mount.

4. The refrigerator appliance of claim 3, wherein the first hinge mount and the second hinge mount each comprise a locating pin extending upward therefrom, wherein the main plate comprises one or more locating slots for locating the top plate to the first hinge mount and the second hinge mount in the closed position.

5. The refrigerator appliance of claim 3, wherein the hinge cover assembly comprises one or more fasteners, wherein the one or more fasteners temporarily fasten the main plate to the first hinge mount and the second hinge mount in the closed position.

6. The refrigerator appliance of claim 1, wherein the hinge cover assembly further comprises one or more dedicated hinges, wherein each dedicated hinge of the one or more dedicated hinges comprises a first element and second element, wherein the first element of each dedicated hinge is hingeably coupled to the second element of each dedicated hinge, wherein the first element of each dedicated hinge is fastened to the top face of the cabinet, and wherein the second element of each dedicated hinge is coupled to the one or more top plates.

7. The refrigerator appliance of claim 6, wherein the cabinet comprises a front edge and a pair of opposing side edges, wherein the one or more dedicated hinges define an axis of rotation extending parallel to one of the front edge or the pair of opposing side edges.

8. The refrigerator appliance of claim 1, wherein the one or more top plates comprise a metal material.

9. The refrigerator appliance of claim 1, wherein one or more components of the refrigerator appliance are housed within the one or more enclosures.

10. A refrigerator appliance defining a vertical direction, a lateral direction, and a transverse direction, the refrigerator appliance comprising:

a cabinet defining a chilled chamber, the cabinet comprising bottom side and top side spaced apart along the vertical direction;

a hinge cover assembly disposed at the top side of the cabinet, the hinge cover assembly defining an enclosure at the top side of the cabinet, the hinge cover assembly comprising:

a first hinge mount disposed at the top side of the cabinet;

a second hinge mount disposed at the top side of the cabinet, the first hinge mount and the second hinge mount spaced apart along the lateral direction; and a top plate hingeably connected to the first hinge mount and the second hinge mount, wherein the first hinge mount and the second hinge mount define an axis of rotation extending parallel to the lateral direction, wherein the top plate is hingeably connected to the first hinge mount and the second hinge mount, wherein the top plate is hingeable about the axis of rotation between an open position and a closed position, and wherein the first hinge mount and the second hinge mount are configured to attach doors of the refrigerator appliance to the cabinet.

11. The refrigerator appliance of claim 10, wherein the cabinet comprises a first side and a second side spaced apart along the lateral direction and a front side and a rear side spaced apart along the transverse direction, wherein the first hinge mount is positioned proximate the first side and the front side, and wherein the second hinge mount is positioned proximate the second side and the front side.

12. The refrigerator appliance of claim 10, wherein the first hinge mount and the second hinge mount each comprise a locating pin extending upward therefrom, wherein the top plate comprises one or more locating slots for locating the top plate to the first hinge mount and the second hinge mount in a closed position.

13. The refrigerator appliance of claim 10, wherein the hinge cover assembly comprises one or more fasteners, wherein the one or more fasteners temporarily fasten the top plate to the first hinge mount and the second hinge mount in a closed position.

14. The refrigerator appliance of claim 10, wherein the top plate comprises a metal material.

15. The refrigerator appliance of claim 10, wherein one or more components of the refrigerator appliance are housed within the enclosure.

* * * * *